United States Patent [19]

Bishop

[11] Patent Number: 4,542,880

[45] Date of Patent: Sep. 24, 1985

[54] POST DRIVER FOR TRACTOR WITH POWER LIFT

[76] Inventor: Crawford A. Bishop, Rte. 1, Box 54, St. Amant, La. 70774

[21] Appl. No.: 526,956

[22] Filed: Aug. 29, 1983

[51] Int. Cl.[4] ..... E21B 19/00

[52] U.S. Cl. ..... 254/29 R; 254/124

[58] Field of Search ..... 254/29 R, 30, 31, 124, 254/127, 8 R, 8 B; 172/111, 439

[56] References Cited

U.S. PATENT DOCUMENTS

| | | | |
|---|---|---|---|
| 2,662,729 | 12/1953 | Fountain | 254/132 |
| 2,888,245 | 5/1959 | Anderson | 254/29 |
| 3,129,924 | 4/1964 | Froh | 254/29 |
| 4,258,905 | 3/1981 | Brabander | 254/29 |

*Primary Examiner*—Frederick R. Schmidt

*Assistant Examiner*—Judy J. Hartman

*Attorney, Agent, or Firm*—David L. Ray

[57] ABSTRACT

An apparatus for driving fence post into the ground operable with a tractor having a power lift mechanism with two lift arms pivotally connected to the tractor for moving upwardly and downwardly in response to hydraulic force applied thereto, the apparatus including two lever arms pivotally connected to the chassis of the tractor, a rigid bar connecting the rear ends of the two lever arms, a pivot arm member rigidly connected to the rigid bar and extending upwardly therefrom, a base member rigidly mountable on the rear of the tractor chassis having a support arm member extending upwardly therefrom, and an elongated drive member pivotally connected to the upper end of the support member and to the pivot arm member for driving posts or stakes into the ground.

8 Claims, 4 Drawing Figures

POST DRIVER FOR TRACTOR WITH POWER LIFT

BACKGROUND OF THE INVENTION

1. Field of the Invention

The invention relates to an apparatus for driving a post vertically into the ground. In particular, the present invention relates to an apparatus which can be attached to a conventional power lift mechanism on a tractor to enable the tractor to drive fence posts into the ground.

2. Brief Description of the Prior Art

Numerous devices have been disclosed in the prior art for adapting a tractor with a power lift mechanism to drive post into the ground and/or to pull post from the ground. Exemplary of these patents are U.S. Pat. Nos. 4,258,905; 3,129,924; 2,888,245; and 2,662,729.

U.S. Pat. No. 4,258,905 discloses an apparatus for driving a post into the ground which is operable in combination with a tractor equipped with a three point hydraulic power lift. The apparatus employs two pivot arms mounted to two stationary members which are actuated by two hydraulic lifting arms to force a central holding assembly upwardly and downwardly to drive posts into the ground. The present invention differs from this apparatus among other things in that fewer pivot points are utilized and that the driving member extends rearwardly from the tractor.

U.S. Pat. No. 3,129,924 discloses a device for driving a post into the ground and pulling a post from the ground which is operable on a tractor having a hydraulic lift mechanism. The device employs a frame having two tubular parallel guide bars with a connecting top bar upon which slides a press head or anvil for driving a post into the ground or lifting a post out of the ground by actuating the hydraulic lift mechanism. The device of the present invention does not employ a tubular frame with parallel upright guides.

U.S. Pat. No. 2,888,245 discloses an apparatus for driving fence post which is operable with a tractor having a hydraulically operated front end loader. This apparatus utilizes a cable and pulleys to force a drive member downwardly to drive a post in the ground. The present invention differs from this patent among other things in that no cable or pulleys are utilized to drive fence post.

U.S. Pat. No. 2,662,729 discloses a device operable with a tractor having a hydraulic lift mechanism for pulling posts from the ground. This device includes a pair of cutting blades attached to a frame which are forced into the side of a wooden post and secured. The cutting blades are then moved up by the hydraulic lift mechanism to pull the post out of the ground. The present invention differs from this reference because no cutting blades or similar means are used to clamp into the side of a post, but instead a post is forced into the ground by applying a driving force to the top of the post.

SUMMARY OF THE INVENTION

In accordance with the present invention there is provided an apparatus for driving fence post into the ground operable with a tractor having a power lift mechanism with two lift arms pivotally connected to the tractor for moving upwardly and downwardly in response to hydraulic force applied thereto, the apparatus including two lever arms pivotally connected to the chassis of the tractor, a rigid bar connecting the rear ends of the two lever arms, a pivot arm member rigidly connected to the rigid bar and extending upwardly therefrom, a base member rigidly mountable on the rear of the tractor chassis having a support arm member extending upwardly therefrom, and an elongated drive member pivotally connected to the upper end of the support member and to the pivot arm member for driving posts or stakes into the ground.

The apparatus of the invention has many advantages over the devices presently available. Some of these advantages are that the apparatus of the invention is simple to construct, easy to operate, and inexpensive. Furthermore, the apparatus of the invention allows a post to be driven at a distance from the tractor so that a person holding the post will not be endangered by the moving members of the apparatus of the invention.

The invention is also light in weight, and is easily attachable and removable from a conventional tractor with a conventional power lift mechanism.

DESCRIPTION OF THE PREFERRED EMBODIMENT

Figure 1:
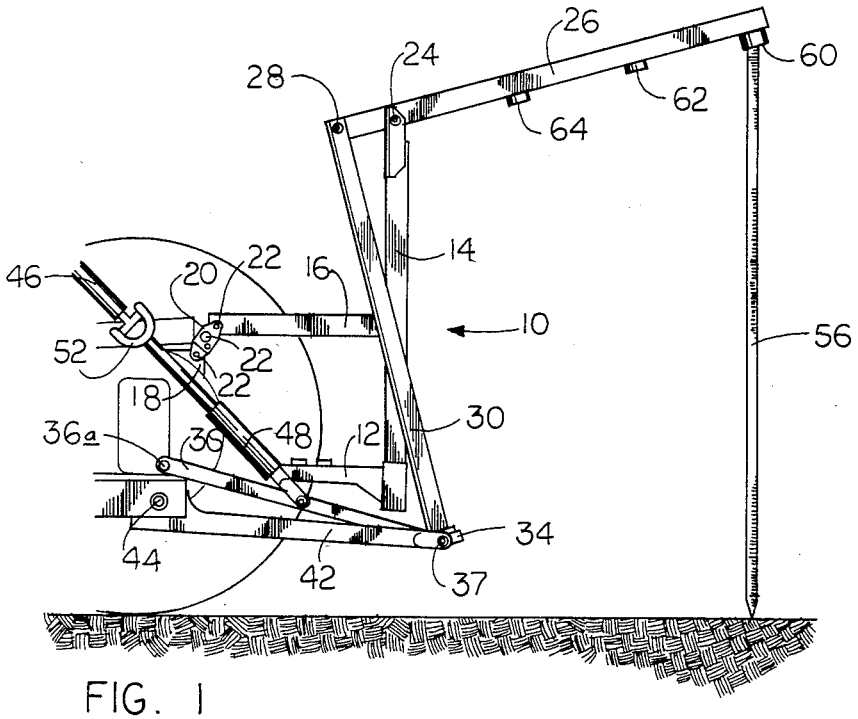
FIG. 1 is a partially cut-away side view of the apparatus of the invention, positioned to begin driving a post in to the ground.

Referring now to the drawings, the post driving apparatus of the present invention is generally indicated by the numeral 10. Apparatus 10 includes a base member 12 rigidly connectable to the chassis 18 of a tractor by any conventional means such as bolting, welding, pinning or the like.

Rigidly connected to the rearward end of the base member 12 is support member 14. Support member 14 may have a horizontal brace member 16 rigidly connected thereto to provide additional support for support member 14, although brace 16 could be eliminated if additional strength is not needed. Horizontal brace member 16 is connected to chassis 18 of the tractor by any conventional means such as a bracket 20 and bolts 22. The length of horizontal brace member 16 may be selected so that the support member 14 is mounted at the desired angle relative to the ground. For example, support member 14 may be mounted in the vertical position or inclined at an acute angle with the ground.

Pivotally connected to support member 14 by bolt or pin 24 is an elongated drive member 26. Elongated drive member 26 is in turn pivotally bolted or pinned at 28 to pivot arm member 30. Pivot arm member 30 is preferably rigidly connected at its base 32 to rigid cross bar 34, although it could be pivotally connected by a pin or bolt if desired. Cross bar 34 is pivotally connected to two lever arms 36 and 38 and to braces 40 and 42 by pins 37 and 39. Braces 40 and 42 are pivotally pinned to the chassis of the tractor at 44 and could be omitted if the extra strength they provide is not needed.

Lever arms 36 and 38 are lifted by lift arms 46 which are conventional hydraulic lift arms connected to the tractor. Lift arms 46 are connected to lever arm 36 and 38 by connectors 48 and 50 having universal joints 52 and 54.

Figure 2:
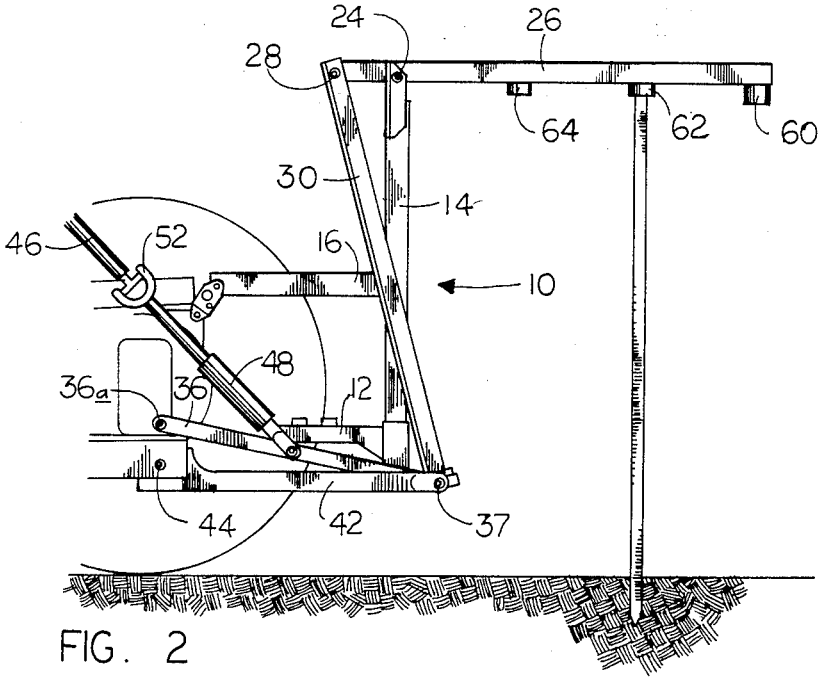
FIG. 2 is a partially cut-away side view of the apparatus of the invention after a post has been driven into the ground.

FIGS. 1 and 2 show the use of the apparatus of the invention to drive a post into the ground. In FIG. 1 a post 56 having a pointed end 58 is shown inserted into one of three or more cups 60, 62 and 64 rigidly attached to drive member 26. In FIG. 1 post 56 is shown inserted in cup 60 which is the cup highest above the ground. Cup 60 would also be the cup lowest to the ground when the pivot arm member 30 is raised to its maximum height. The cups 62 and 64 are correspondingly lower in height when drive member 26 is in its raised position and therefore can be used to drive shorter poles into the ground.

After a post 56 is inserted into cup 60 as shown in FIG. 1, upward hydraulic force is applied to lift arms 46 by actuation of the existing conventional hydraulic lift mechanism. Lever arms 36 and 38 pivot upwardly about points bolts or pins 36*a* and 38*a*. As lever arms 36 and 38 pivot upwardly, base 34 is forced upwardly as is pivot arm member 30 which is rigidly connected to base 34.

Figure 3:
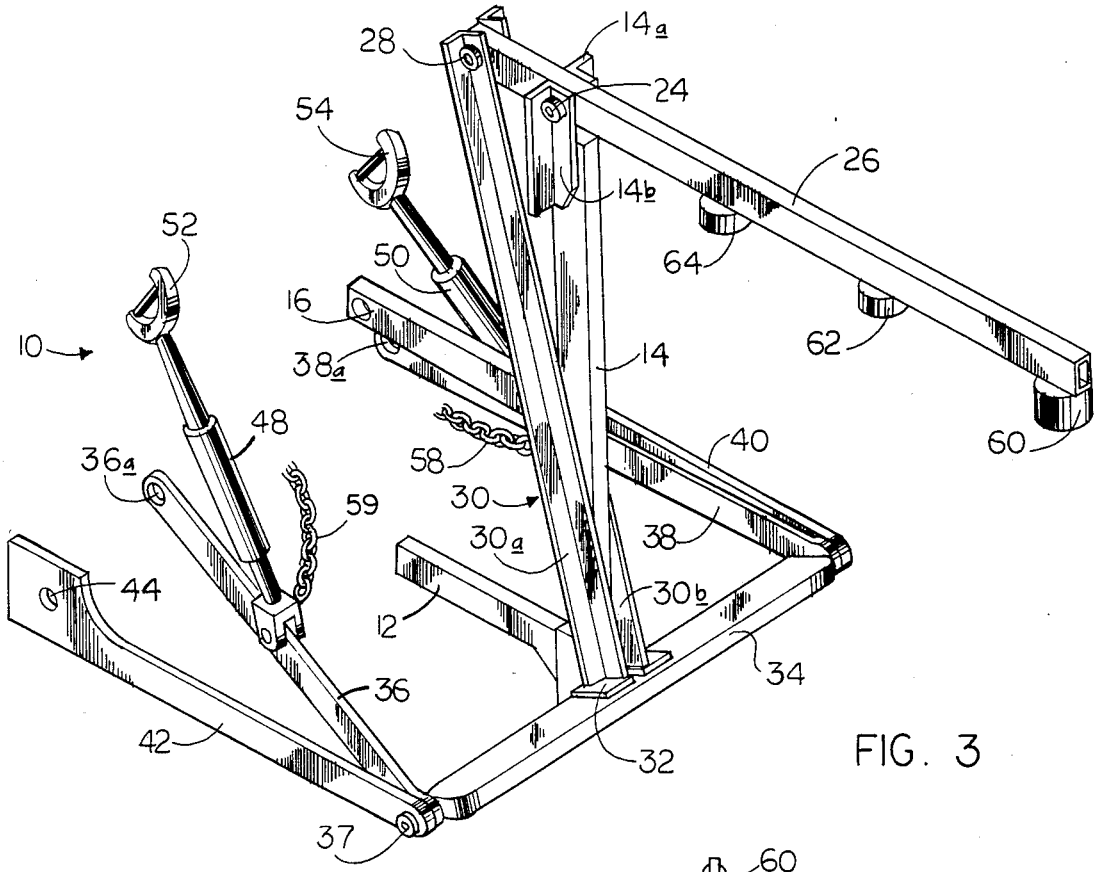
FIG. 3 is a perspective view of the driving apparatus of the invention.
Figure 4:
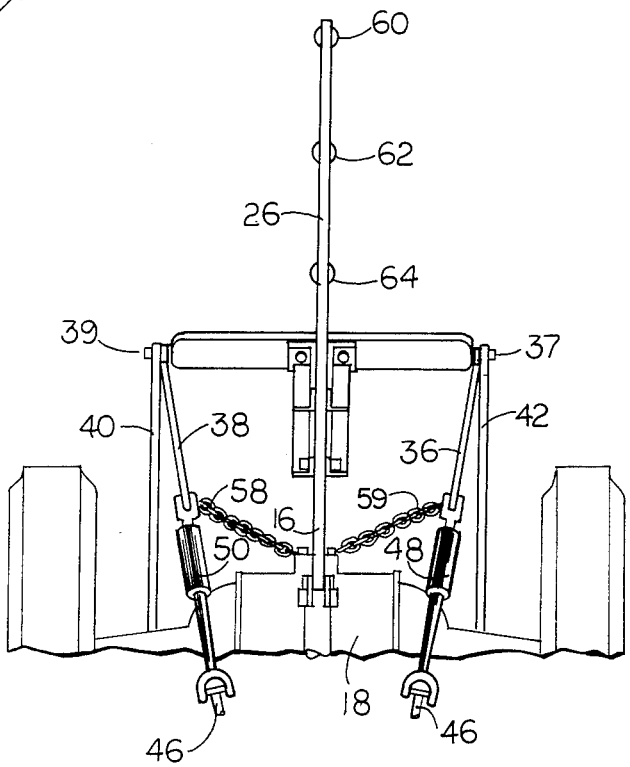
FIG. 4 is a partially cut-away top view of the apparatus of the invention.

The upward movement of pivot arm member 30 causes the end of drive arm 26 pinned or bolted to pivot arm member 30 at 28 to move upwardly, thereby forcing the rear end of drive member 26, and cups 60, 62 and 64, downwardly, driving post 56 into the ground. Braces 40 and 42 pivot upwardly as lever arms 36 and 38 move upwardly. If desired, a pair of chains 58 and 60 can be attached to pivot 36 and 38 as shown in the FIGS. 2 and 3 and secured to the chassis of the tractor. The chains help prevent lever arms 36 and 38 from being forced into contact with one of the tires of the tractor if the lever arms of apparatus of the invention was struck from the side. The chains 58 and 60 can be omitted if desired.

Support member 14 preferably has a rectangular cross section. Member 14 may be hollow or solid as desired. At the upper end of member 14 are two pieces of angle iron 14*a* and 14*b* welded or bolted to member 14 having a bolt 24 therethrough which is also fitted through member 26 to enable 26 to pivot about bolt 24. Support member 14 may be connected to base member 12 by welding, bolting or any other conventional means.

Pivot arm member 30 is preferably made of two pieces of elongated angle iron 30*a* and 30*b* having flat plates welded at their bottom ends connected to base 34 by welding or bolting. At the upper end of pieces 30*a* and 30*b* is a bolt 28 which fits through both members and through drive member 26 enabling drive member 26 to pivot about bolt 28.

All of the components of the invention are preferably made from steel or steel alloy, although alunimum and other conventional alloys may be utilized if so desired.

Although the preferred embodiments of the present invention have been disclosed and described in detail above, it should be understood that the invention is in no sense limited thereby, and its scope is to be determined by that of the following claims.

What is claimed:

1. An apparatus for driving a post into the ground operable in combination with a tractor having a chassis and a power lift mechanism with two lift arms, comprising:

a. at least two lever arm means pivotally connectable to the chassis of a tractor, said lever arm means being connectable to the lift arms of the power lift mechanism of a tractor, b. rigid bar means connected to each end of said lever arms means, c. pivot arm member means connected to said rigid bar means, d. base member means rigidly connectable to the chassis of a tractor, e. support member means rigidly connected to said base member means, said support member means having brace member means connected to said support member means and connectable to the chassis of a tractor, and a second brace member means being pivotally connected to said rigid bar means and pivotally connectable to the chassis of a tractor, and f. drive member means pivotally connected to said support member means and said pivot arm member means.

2. The apparatus of claim 1 wherein said drive member means has a front end and a rear end.

3. The apparatus of claim 2 wherein said pivot arm means is pivotally connected to said front end of said drive member means.

4. The apparatus of claim 3 wherein said support member means is pivotally connected to said drive member means between said front end and said rear end of said drive member means.

5. The apparatus of claim 1 wherein at least one cup means is connected to said drive member means.

6. The apparatus of claim 5 wherein said cup means is connected to the bottom of said drive member means and has an open portion facing downwardly toward the ground when said apparatus for driving a post is connected to a tractor.

7. An apparatus for driving a post into the ground operable in combination with a tractor having a chassis and a power lift mechanism with two lift arms, comprising:

a. at least two lever arm means pivotally connectable to the chassis of a tractor, said lever arm means being connectable to the lift arms of the power lift mechanism of a tractor, b. rigid bar means connected to each end of said lever arm means, c. pivot arm member means connected to said rigid bar means, d. base member means rigidly connectable to the chassis of a tractor, e. support member means rigidly connected to said base member means, said support member means having brace member means connected to said support member means, said brace member means being connectable to the chassis of a tractor, and a second brace member means being pivotally connected to said rigid bar means and pivotally connectable to the chassis of a tractor, and f. drive member means pivotally connected to said support member means and said pivot arm member means, said drive member means having a front end and a rear end, said pivot arm means being pivotally connected to said front end of said drive member means, said support member means being pivotally connected to said drive member means between said front end and said rear end of said drive member means.

8. The apparatus of claim 7 wherein at least one cup means is connected to said drive member means.

* * * * *